US008499460B1

(12) United States Patent
Pearman

(10) Patent No.: US 8,499,460 B1
(45) Date of Patent: Aug. 6, 2013

(54) SPRING ASSISTED KNIFE HAVING SEPARATE CAM INSERT

(76) Inventor: Robert E. Pearman, Jonesborough, TN (US)

( * ) Notice: Subject to any disclaimer, the term of this patent is extended or adjusted under 35 U.S.C. 154(b) by 242 days.

(21) Appl. No.: 13/097,636

(22) Filed: Apr. 29, 2011

(51) Int. Cl.
*B26B 1/02* (2006.01)

(52) U.S. Cl.
USPC ..... 30/155; 30/158; 30/159

(58) Field of Classification Search
USPC ..... 30/153, 155–161
See application file for complete search history.

(56) References Cited

U.S. PATENT DOCUMENTS

| | | | | |
|---|---|---|---|---|
| 3,942,249 | A * | 3/1976 | Poehlmann | 30/160 |
| 4,177,560 | A * | 12/1979 | Sakurai | 30/160 |
| 4,272,887 | A * | 6/1981 | Poehlmann | 30/161 |
| 4,439,922 | A * | 4/1984 | Sassano | 30/161 |
| 4,541,175 | A * | 9/1985 | Boyd et al. | 30/161 |
| 4,551,917 | A * | 11/1985 | Walker | 30/161 |
| 4,604,803 | A * | 8/1986 | Sawby | 30/161 |
| 4,750,267 | A * | 6/1988 | Boyd | 30/161 |
| 4,918,820 | A * | 4/1990 | Korb et al. | 30/161 |
| 5,495,674 | A * | 3/1996 | Taylor, Jr. | 30/160 |
| 5,661,908 | A * | 9/1997 | Chen | 30/161 |
| 5,769,094 | A | 6/1998 | Jenkins, Jr. et al. | |
| 5,819,414 | A * | 10/1998 | Marifone | 30/160 |
| 5,964,035 | A * | 10/1999 | Poehlmann | 30/161 |
| 5,979,065 | A * | 11/1999 | Hsu | 30/161 |
| 6,134,788 | A * | 10/2000 | Chen et al. | 30/157 |
| 6,308,420 | B1 | 10/2001 | Moser | |
| 6,363,615 | B1 * | 4/2002 | Moser | 30/161 |
| 6,397,477 | B1 | 6/2002 | Collins | |
| 6,427,334 | B2 | 8/2002 | Onion | |
| 6,438,848 | B1 | 8/2002 | McHenry et al. | |
| D474,669 | S | 5/2003 | Onion | |
| 6,591,504 | B2 | 7/2003 | Onion | |
| 6,684,510 | B1 | 2/2004 | Collins | |
| 6,826,836 | B1 * | 12/2004 | Lin | 30/161 |
| 6,941,661 | B2 | 9/2005 | Frazer | |
| 6,959,494 | B2 | 11/2005 | Taylor | |
| 7,124,509 | B1 | 10/2006 | Hawk | |
| 7,231,718 | B2 * | 6/2007 | Outen | 30/161 |
| 7,275,321 | B2 * | 10/2007 | Cheng | 30/160 |
| 7,278,213 | B2 * | 10/2007 | Pardue et al. | 30/160 |
| 7,313,866 | B2 | 1/2008 | Linn et al. | |
| 7,340,838 | B2 | 3/2008 | Onion | |
| 7,370,421 | B2 | 5/2008 | Onion et al. | |
| 7,395,599 | B2 | 7/2008 | Onion | |
| 7,513,045 | B2 * | 4/2009 | Kain | 30/158 |
| 7,676,932 | B2 | 3/2010 | Grice | |
| 7,698,821 | B2 * | 4/2010 | Ralph | 30/160 |
| 7,748,122 | B2 * | 7/2010 | Duey | 30/159 |

(Continued)

FOREIGN PATENT DOCUMENTS

FR 2705606 A1 * 12/1994

*Primary Examiner* — Jason Daniel Prone
(74) *Attorney, Agent, or Firm* — Luedeka Neely Group, PC

(57) ABSTRACT

A spring-assisted folding knife, including a one-piece knife blade having a proximal end and including a receiver on one side of its proximal end having a through bore; a blade insert made of a separate piece of material than the blade having a rear surface configured to be seated into the receiver, an opposite front surface, and a central bore extending between the rear surface and the front surface; and a coil spring received on the rear surface of the blade insert, the coil spring having a first end secured to the blade insert and an opposite second end secured to a fixed rigid surface of the knife.

4 Claims, 9 Drawing Sheets

U.S. PATENT DOCUMENTS

| | | | | |
|---|---|---|---|---|
| 7,827,697 | B2 | 11/2010 | Lake | |
| 7,854,067 | B2 | 12/2010 | Lake | |
| 8,171,645 | B2 * | 5/2012 | Duey | 30/159 |
| 8,215,021 | B2 * | 7/2012 | Seber et al. | 30/161 |
| 8,291,597 | B2 * | 10/2012 | Hawk et al. | 30/155 |
| 8,375,590 | B2 * | 2/2013 | Duey | 30/159 |
| 2003/0213134 | A1 | 11/2003 | Sakai | |
| 2004/0134075 | A1 * | 7/2004 | Chu | 30/161 |
| 2004/0154170 | A1 * | 8/2004 | Kain et al. | 30/161 |
| 2004/0158991 | A1 * | 8/2004 | Freeman | 30/161 |
| 2005/0097755 | A1 | 5/2005 | Galyean et al. | |
| 2005/0241154 | A1 * | 11/2005 | Lake | 30/160 |
| 2005/0257377 | A1 * | 11/2005 | Lu | 30/153 |
| 2006/0236549 | A1 | 10/2006 | Martin | |
| 2006/0283021 | A1 * | 12/2006 | Chu | 30/155 |
| 2007/0068000 | A1 | 3/2007 | Onion | |
| 2007/0068002 | A1 | 3/2007 | Onion | |
| 2008/0222896 | A1 | 9/2008 | Marfione et al. | |
| 2008/0276463 | A1 * | 11/2008 | Kao | 30/155 |
| 2009/0056146 | A1 * | 3/2009 | Duey | 30/159 |
| 2009/0144986 | A1 | 6/2009 | Frazer | |
| 2009/0260234 | A1 * | 10/2009 | Lai | 30/161 |
| 2009/0277015 | A1 * | 11/2009 | Duey | 30/160 |
| 2010/0192381 | A1 | 8/2010 | Sakai | |
| 2010/0199501 | A1 | 8/2010 | Hernandez | |
| 2010/0212163 | A1 | 8/2010 | Liu | |
| 2010/0257742 | A1 | 10/2010 | Lake | |
| 2011/0010947 | A1 * | 1/2011 | Freeman | 30/159 |
| 2012/0144677 | A1 * | 6/2012 | Chang | 30/161 |

* cited by examiner

SPRING ASSISTED KNIFE HAVING SEPARATE CAM INSERT

FIELD

This disclosure relates to the field of folding knives. More particularly, this disclosure relates to improvements in the design of knives that utilizes a coil spring and a cam insert separate from the blade and are particularly useful for the manufacture of knives having blades formed of materials other than metal.

BACKGROUND

Improvement is desired in the design of spring assisted folding knives. Conventionally, spring assisted knives utilize components that are substantially exposed to the elements, which can undesirably affect the performance of the knife especially in opening.

Conventional spring assisted knives also typically utilize metal blades. However, the use of non-metal blades for knifes, such as blades made of ceramic or plastic, is often desired but blades of such non-metal materials are not suited for use with conventional spring assist structures. The present disclosure advantageously relates to a spring assisted knife that may use non-metal knife blades.

SUMMARY

The above and other needs are met by an improved spring-assisted folding knife.

In one embodiment, the knife includes a one-piece knife blade having a proximal end and including a receiver on one side of its proximal end having a through bore; a blade insert including a separate piece of material than the blade having a rear surface configured to be seated into the receiver, an opposite front surface, and a central bore extending between the rear surface and the front surface.

A coil spring is received on the rear surface of the blade insert, the coil spring having a first end secured to the blade insert and an opposite second end secured to a fixed rigid surface of the knife. A pivot extends through the through bore of the blade, the central bore of the insert, and the coil spring. The coil spring serves to assist opening of the blade of the knife from a closed position to an open position.

In another aspect, the blade is made of a ceramic or other non-metal material. The structure of the disclosure also provides additional advantages, such as location of the drive mechanism in a cavity in the handle so as to be protected from exposure to dirt and other elements that are detrimental to conventional spring-assisted knives.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
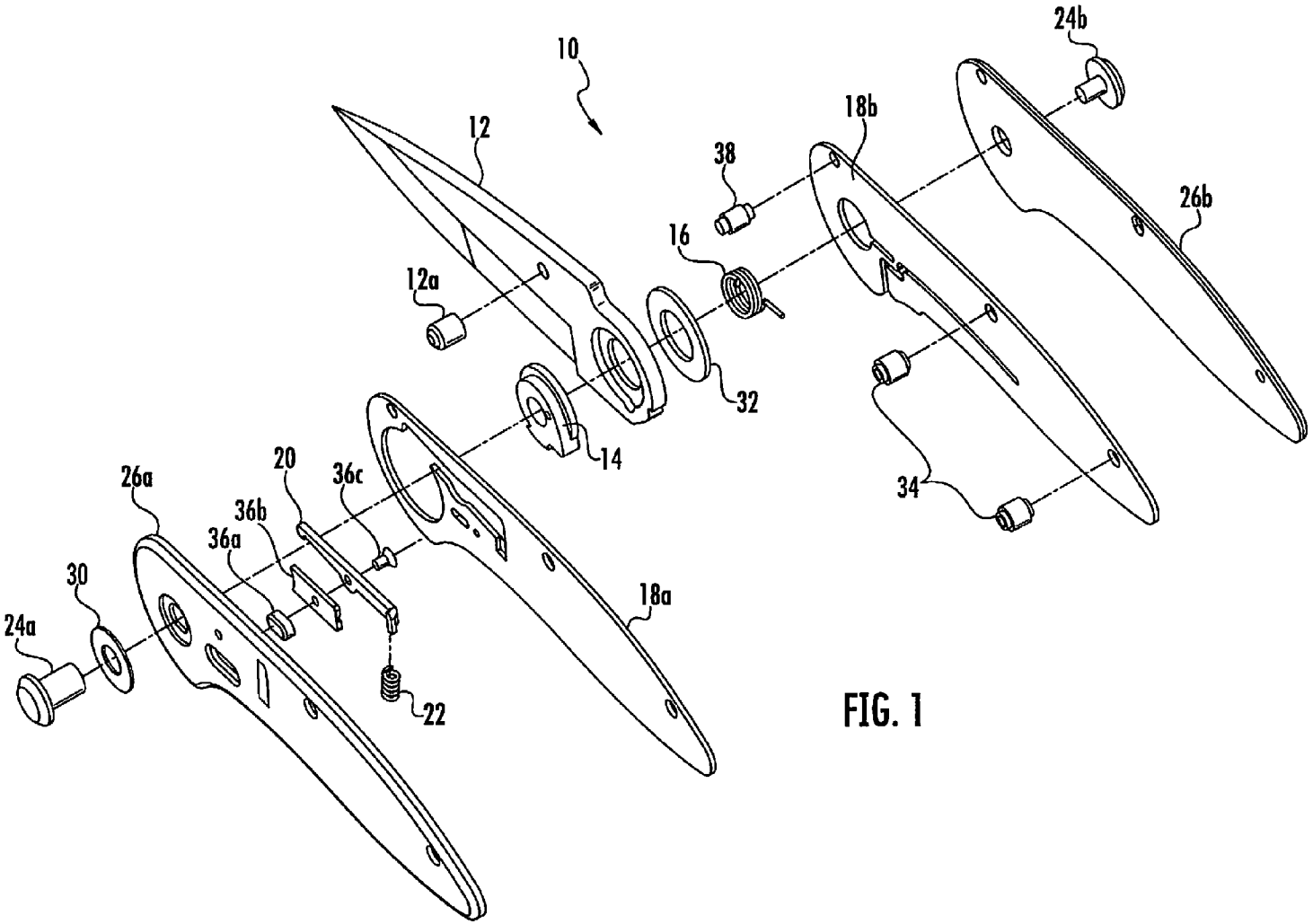
FIG. 1 is an exploded perspective view of a knife according to the disclosure.

With reference to the drawings, and initially to FIG. 1, the disclosure relates to a spring-assisted knife 10 having as major components a blade 12 having thumb screw 12*a* and a cutting surface 12*b*, a blade insert 14, a coil spring 16, liners 18*a* and 18*b*, a rocker arm 20, a compression spring 22, blade pivot members 24*a* and 24*b*, and handle members 26*a* and 26*b*. Additional structure of the knife 10 that facilitates assembly includes washers 30 and 32, spacers 34, latch button 36*a*, latch 36*b*, and latch screw 36*c*, and blade stop 38.

Figure 2:
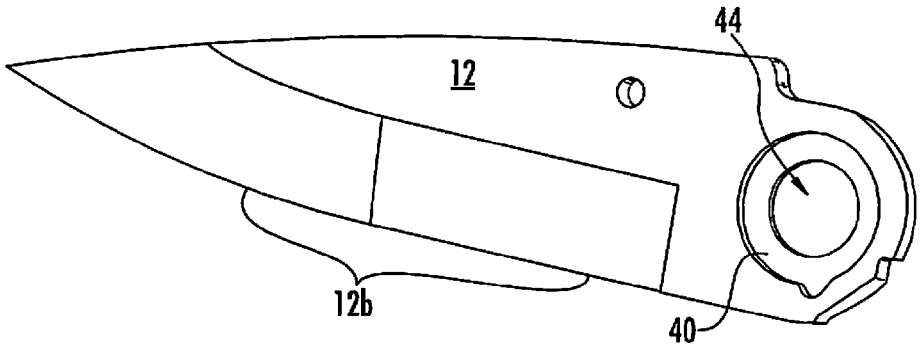
FIGS. 2 and 3 show a blade of the knife of FIG. 1.
Figure 3:
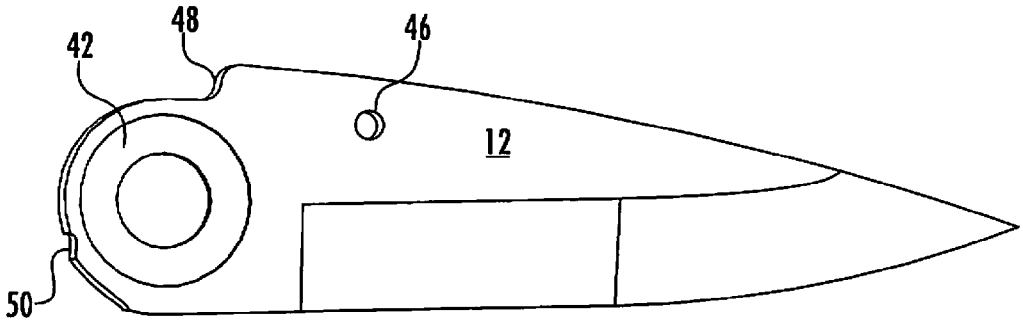

With reference to FIGS. 2 and 3, the blade 12 may advantageously be made of a non-metal material such as ceramic. In this regard, it is noted that ceramic and other non-metal blades have conventionally been unsuitable for implementation into a spring-assisted knife. The disclosure overcomes the prior unsuitability by combining a non-metal blade with the blade insert 14 to provide improved strength characteristics and suitability for providing a spring-assisted knife.

The blade 12 includes a receiver 40 on one side of its proximal end configured to fittingly receive the blade insert 14 and seat the blade insert 14 such that as the blade 12 and the blade insert 14 do not move relative to one another. The opposite side of the blade has a recess 42 to seat the washer 32. A bore 44 extends through the receiver 40 and the recess 42. Aperture 46 is located along an upper edge of the blade 12 to receive the thumb screw 12*a*. The proximal end of the blade 12 is rounded and the step-down from the upper edge of the blade to the proximal end of the blade defines a shoulder 48 configured for abutting the blade stop 38 of the knife 10 to define the fully open position of the blade 12. A notch 50 is defined on the rounded proximal end of the blade 12 for contacting a portion of the liner 18*b* for locking the blade 12 in the fully open position, as explained more fully below.

Figure 4:
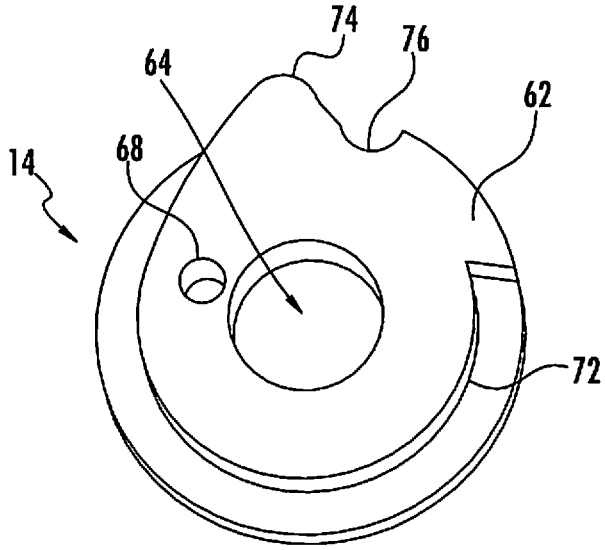
FIGS. 4 and 5 show a blade insert of the knife of FIG. 1.
Figure 5:
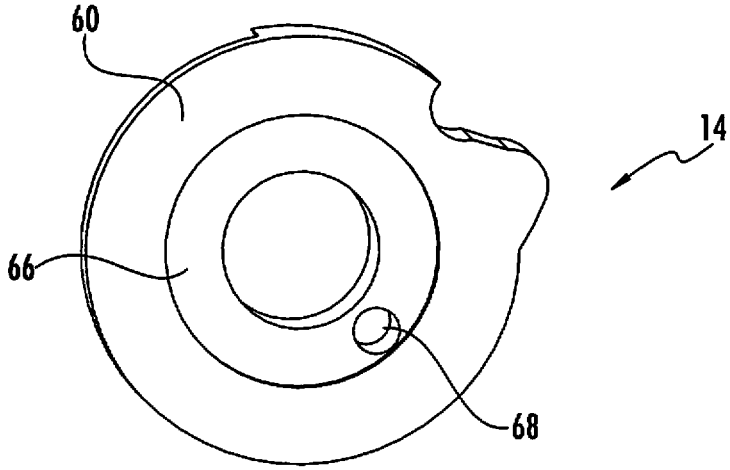
Figure 6:
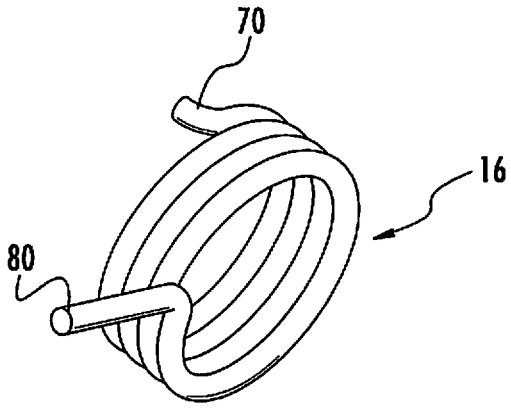
FIG. 6 shows a coil spring of the knife of FIG. 1.
Figure 7:
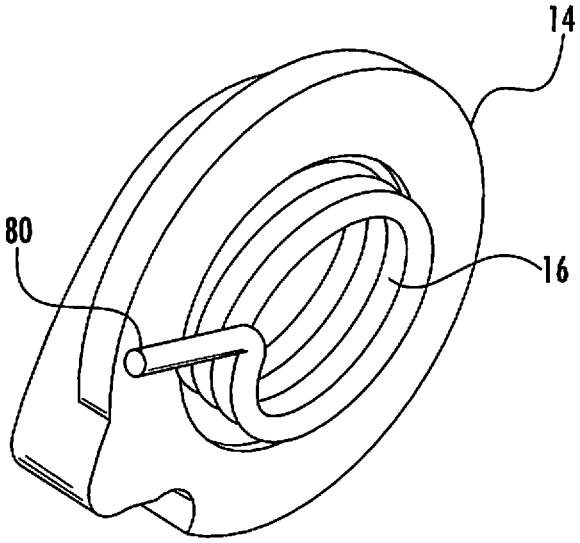
FIG. 7 shows the coil spring installed within the blade insert of FIGS. 4 and 5.

With reference to FIGS. 4 and 5, the blade insert 14 is preferably made of metal, such as stainless steel, and is generally doughnut-shaped having a rear surface 60 that is configured to be seated into the receiver 40 and an opposite front surface 62. A central bore 64 extends between the rear surface 60 and the front surface 62. The rear surface 60 includes an annular recess 66 configured to receive the spring 16 and having an aperture 68 for engaging a free end 70 of the spring 16 (FIGS. 6 and 7). The front surface 62 of the blade insert 14 includes a raised cam surface 72 having a projecting lobe 74 adjacent a detent 76.

The spring 16 is a coil spring having the free end 70 and an opposite free end 80. The relatively flat portion of the spring 16 adjacent the end 70 is received by the annular recess 66, with the free end 70 inserted into the aperture 68. The spring characteristics are selected to provide spring-assisted opening of the knife 10 and will depend upon the size of the blade, weight of the blade, and other characteristics of the knife.

Figure 8:
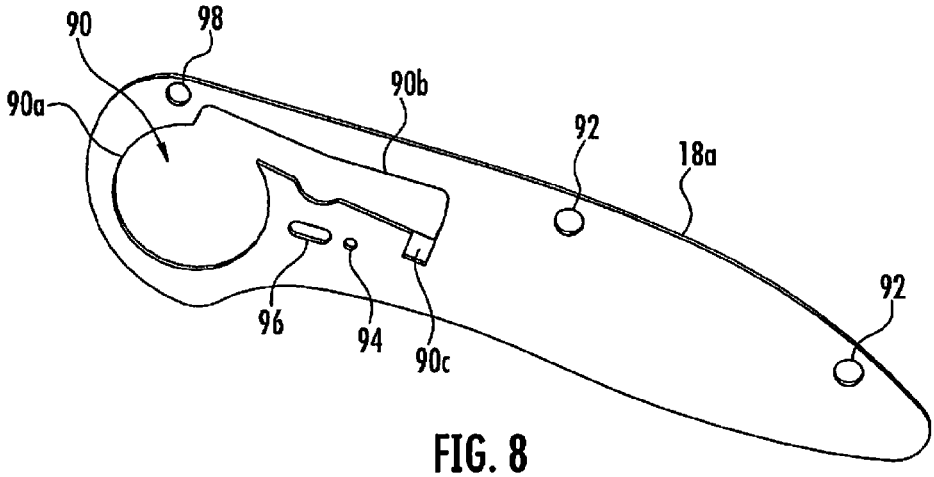
FIGS. 8 and 9 show liners of the knife of FIG. 1, with FIG. 9 shown receiving a portion of the coil spring of FIGS. 6 and 7.

With reference to FIG. 8, the liner 18*a* is made of a flat rigid material such as aluminum plate and includes a cutout 90 having a substantially circular portion 90*a* configured to accept the blade insert 14, an adjoining elongate portion 90*b* configured to accept the rocker arm 20. A recess 90*c* is located below the elongate portion 90*b* for receiving the compression spring 22. Apertures 92 are located through the liner 18*a* for receiving one side of the spacers 34. Aperture 94 is located to receive a small projection of the latch plate 36*b*. Groove 96 is located to receive and permit sliding of the latch screw 36*c* when it is connected to the latch plate 36*b*. Aperture 98 is located to receive one side of the blade stop 38.

Figure 9:
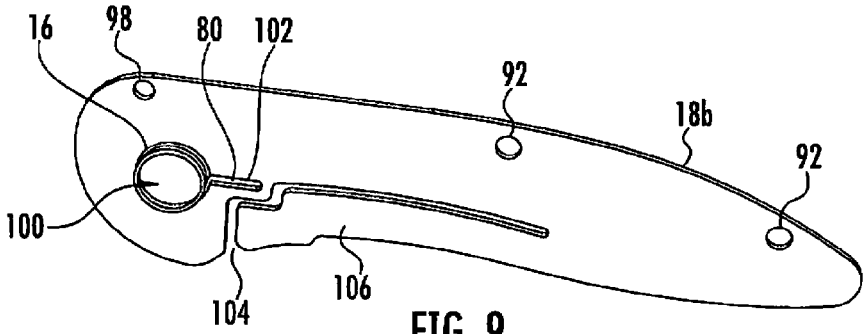

With reference to FIG. 9, the liner 18*b* is made of a rigid flat material such as aluminum plate and is configured to have the same profile as the liner 18*a*. The liner 18*b* includes the apertures 92 and 98 for receiving the other sides of the spacers 34 and the blade stop 38, respectively. A circular cutout 100 is located in alignment with the circular portion 90*a* of the liner 18*a* for passage of the blade pivot member 24*b* and location proximate the spring 16 when it is mounted on the blade insert 14. A linear recess 102 is located adjacent the cutout 100 for receiving the end 80 of the spring 16, it being understood that the liner 18*b* provides a fixed rigid surface to which the end 80 of the spring is secured. An elongate stepped slot 104 is cut through a lower portion of the liner 18*b* to define a lock plate 106. It will be appreciated that the lock 106 is unflexed so as to bear against the back-side of the lobe 74 and thereby lock the blade 12 against closing. To close the blade 12, a user must first manually move or flex the lock 106 outwardly so as to permit the blade insert 14 to pass and once again maintain the lock 106 in the flexed state.

Figure 10:
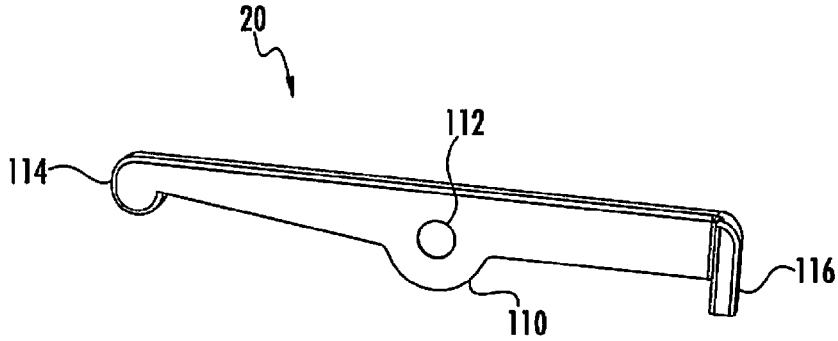
FIG. 10 shows a rocker component of the knife of FIG. 1.
Figure 11:
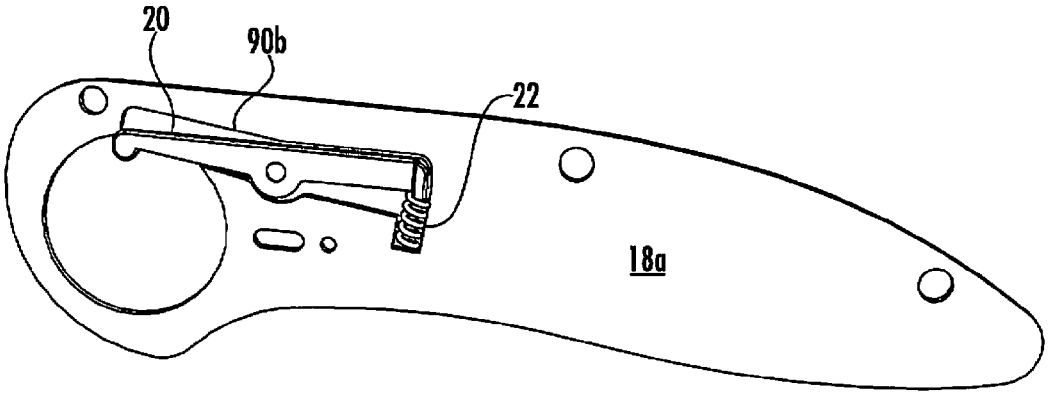
FIG. 11 shows the rocker component located within the liner of FIG. 8, with a compression spring installed.

With reference to FIG. 10, the rocker 20 is preferably made of metal and includes a central pivot lobe 110 and pivot aperture 112, with a cam engagement end 114 and an opposite spring engagement end 116. As shown in FIG. 11, one side of the rocker 20 is received in the elongate portion 90*b* of the liner 18*a* with sufficient operational clearance, with the spring 22 installed on the spring engagement end 116 of the rocker 20 and received in the recess 90*c* of the liner 18*a*.

Figure 12:
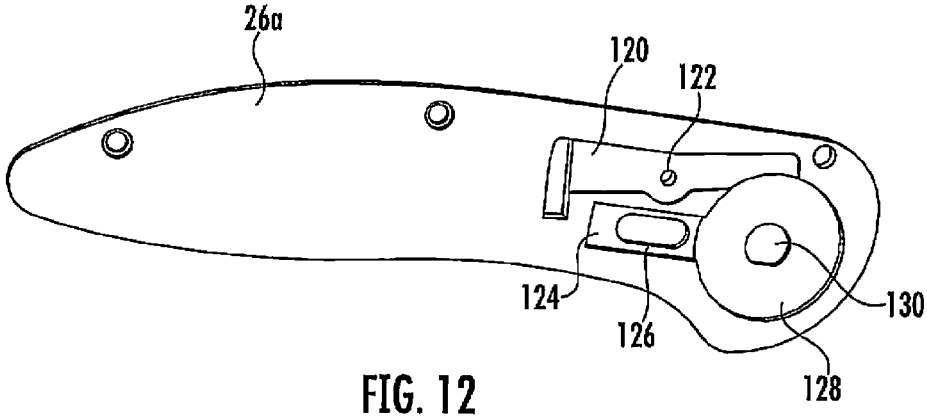
FIG. 12 shows a handle of the knife of FIG. 1 configured to cooperate with the rocker and liner of FIG. 11.

As shown in FIG. 12, the handle 26*a* includes a recess 120 on an inner surface thereof configured to receive the other side of the rocker 20 with sufficient operational clearance. A pivot 122 extends from the handle 26*a* for engaging the pivot aperture 112 to permit pivoting of the rocker 20. The handle 26*a* also includes a latch recess 124, a latch button aperture 126, a washer recess 128, and a pivot member aperture 130.

Figure 13:
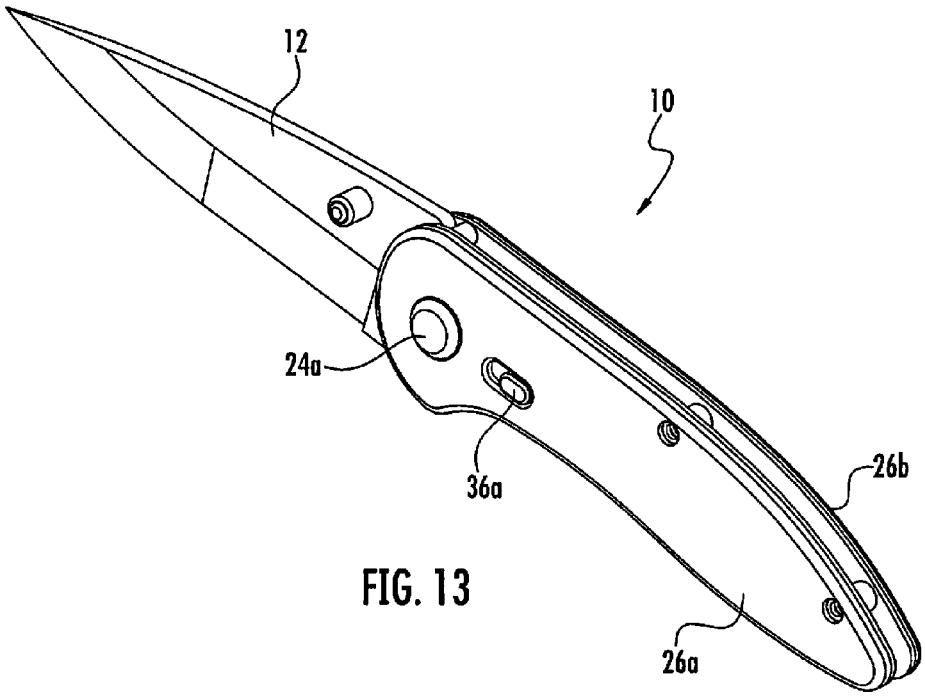
FIG. 13 is an assembled view of the knife of FIG. 1, with a blade of the knife in an open position.
Figure 14:
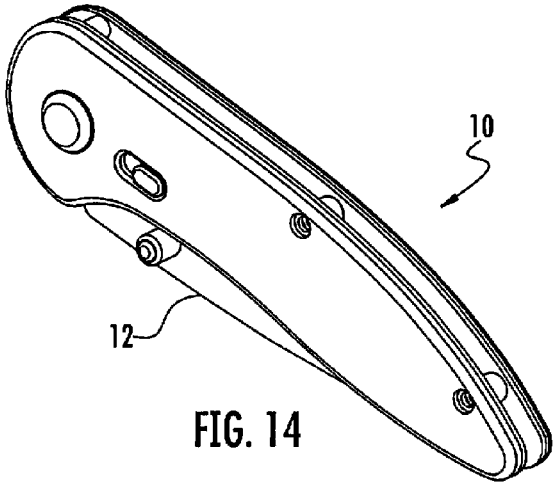
FIG. 14 is an assembled view of the knife of FIG. 1, with a blade of the knife in a closed position.
Figure 15A:
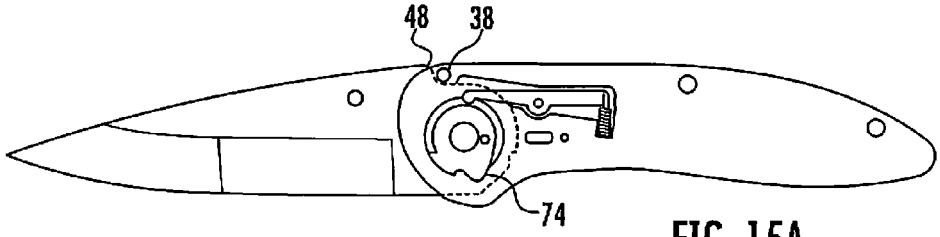
FIG. 15 illustrates operation of the knife between the open position and the closed position.
Figure 15B:
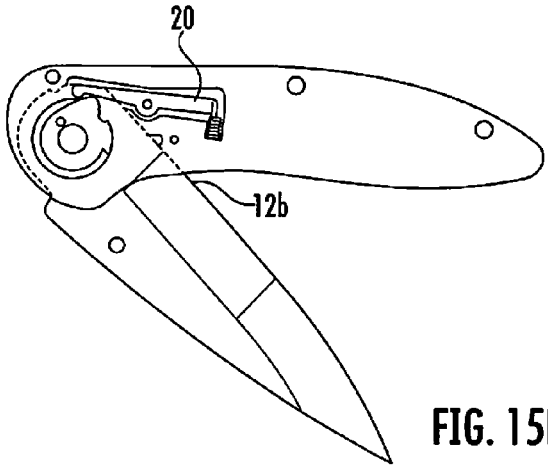
Figure 15C:
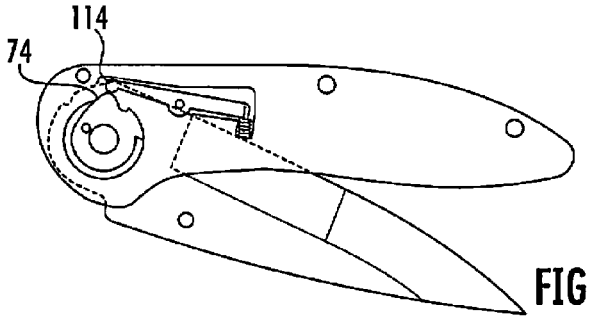
Figure 15D:
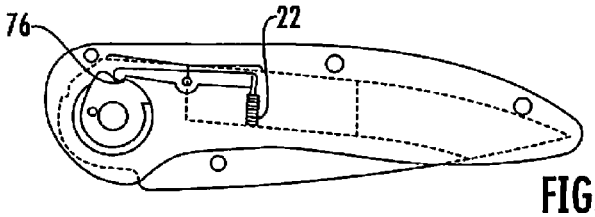

With reference to FIG. 13, the assembled knife 10 is shown in the open orientation. FIG. 14 shows the knife 10 in the closed orientation. The assembled knife 10 is configured with the blade insert 14 seated in the receiver 40 on one side of the blade 12 and the spring 16 on the opposite side of the blade 12, seated in the annular recess 66 of the blade insert 14, with the pivot members 24*a* and 24*b* secured together and bearing against the handles to provide a pivot point about which the blade 12 pivots between the open and closed positions. The free end 80 of the spring 16 is seated in the linear recess 102 of the liner 18*b* and provides an anchor point for tensioning of the spring 16. Opening of the blade 12 will decrease tension of the spring 16, while closing of the blade 12 will increase the tension of the spring 16. The rocker 20 in combination with the spring 22 and the lobe 74 and detent 76 of the blade insert 14 serve to urge the blade 12 to remain in the closed position. However, this may be overcome by a user intentionally urging the blade 12 away from the closed position, with the tension of the coil spring 16 thereafter serving to assist in the opening of the knife to position the blade 12 in the open position, as halted by contact of the shoulder 48 of the blade 12 against the blade stop 38. As an additional feature to help maintain the blade 12 against accidental opening, the latch 36*b*, operated by the button 36*a*, is positioned to abut the blade insert 14 when the blade 12 is in the closed position to provide a latching feature. The latch 36*b* is easily moved out of engagement with the blade insert 14 by moving the button 36*a*.

For example, with reference to FIG. 15, movement of the blade 12 from the open position to the closed position is depicted. An open position of the knife 10 is shown as position A. As will be appreciated, the shoulder 48 of the blade 12 is against the blade stop 38. In addition, it will be understood that the lock 106 is in a flexed or biased state to bear against a portion of the blade insert 14 when the blade is in the closed position and throughout opening of the blade until just prior to the blade 12 becoming fully opened. When the blade 12 is fully opened, the blade insert 14 has rotated so as to have the back-side of the lobe pass by the lock 106 such that there is no portion of the blade insert 14 available to maintain the lock 106 in its flexed position. Thus, the lock 106 becomes unflexed and bears against the back-side of the lobe 74 and thereby locks the blade 12 against closing. When the blade 12 is in the fully open position (A), the rocker 20 does not interfere with opening or closing of the blade 12.

To close the blade 12, a user must first manually move or flex the lock 106 outwardly so as to permit the blade insert 14 to pass and once again maintain the lock 106 in the flexed state. Once closure of the blade 12 begins, as represented by position B, the user is applying pressure to close the blade 12 and is thereby increasing the tension of the spring 16. As will be appreciated, the cam engagement end 114 of the rocker 20 is approaching the lobe 74 as the blade 12 begins to close as shown in position B, at which point the cutting surface of the blade 12 is just beginning to enter again into the enclosed space of the handles, representing about 130 degrees of closure, 180 degrees representing full closure. In this position, the rocker 20 does not interfere with opening or closing of the blade 12.

In the next position C, representing about 160 degrees of closure of the blade 12, it will be noted that the cam engagement end 114 of the rocker 20 is a the highest point of the lobe 74 and that any further rotation of the blade 12 toward closure will position the cam engagement end 114 of the rocker 20 past the lobe 74. With the cam engagement end 114 past the lobe 74, the rocker 20 does not interfere with closing of the blade 12, but will resist opening of the blade 12.

In the fully closed blade position D, representing 180 degrees of closure, the cam engagement end 114 is urged by the spring 22 against the detent 76 of the blade insert 14 to provide a closed position force and a user must exert force sufficient to overcome the closed position force to open the blade. As the blade 12 is opened from the closed position D to the open position A, it will be understood that once the blade 12 is urged past the position C, such that the cam end 114 of the rocker 20 is past the lobe 74 as represented by position B, the tension of the coil spring 16 will exert an opening force to quickly open the blade 12 to the open position A.

As will be appreciated, the use of a blade insert such as the blade insert 14 enables provision of a spring-assisted knife for blades that are not made of metal. However, the blade insert 14 may be used with a metal blade, and provides additional advantages, such as location of the drive mechanism, e.g., the coil spring 16 behind the blade 12 in a cavity in the handle so as to be protected from exposure to dirt and other elements that are detrimental to conventional spring-assisted knives.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

The invention claimed is:

1. A spring-assisted folding knife, comprising:

a one-piece knife blade having a proximal end and including a receiver on one side of the proximal end having a through bore;

a rotatable blade insert comprising a separate piece of material than the blade and having a rear surface configured to be seated into the receiver, an opposite front surface, and a central bore extending between the rear surface and the front surface;

a coil spring received on the rear surface of the blade insert, the coil spring having a first end secured to the blade insert and an opposite second end secured to a fixed rigid surface of the knife; and a pivot extending through the through bore of the blade, the central bore of the insert, and the coil spring;

wherein, the coil spring serves to assist opening of the blade of the knife from a closed position to an open position, and the blade insert rotates as the blade goes between the closed position and the open position.

2. The knife of claim 1, wherein the blade insert includes a cam surface and the knife further includes a compression spring and a rocker member operatively associated with the compression spring and pivotally mounted to the knife, the rocker member having a cam engaging end and an opposite spring engaging end, wherein the spring engaging end of the rocker member bears against the compression spring and the compression spring urges the spring engaging end of the rocker member so that rocker member pivots and urges the cam engaging end of the rocker member against the cam surface of the blade insert.

3. The knife of claim 2, wherein the cam surface includes a detent and when the blade is in the closed position the cam engaging end of the rocker bears against the detent to resist movement of the blade from the closed position towards the open position.

4. The knife of claim 1, wherein the blade is made of a non-metal material.

* * * * *